United States Patent [19]

Fethke et al.

[11] 4,165,805

[45] Aug. 28, 1979

[54] BLISTER PACKAGES FOR SCISSORS, PLIERS AND OTHER HAND TOOLS

[75] Inventors: Wayne G. Fethke, Wausau; Paul C. Mayer, Rothschild, both of Wis.

[73] Assignee: Fiskars Manufacturing Corporation, Wausau, Wis.

[21] Appl. No.: 911,545

[22] Filed: Jun. 1, 1978

[51] Int. Cl.[2] ..... B65D 73/00; B65D 85/00

[52] U.S. Cl. ..... 206/349; 206/461; 206/471

[58] Field of Search ..... 30/125, 143, 151, 154–155, 30/231–233; 206/349, 461–465, 467–468, 470, 471

[56] References Cited

U.S. PATENT DOCUMENTS

| | | | |
|---|---|---|---|
| 3,891,088 | 6/1975 | Huebner | 206/349 |
| 3,972,417 | 8/1976 | Iten et al. | 206/461 X |

FOREIGN PATENT DOCUMENTS

| | | | |
|---|---|---|---|
| 2444606 | 4/1976 | Fed. Rep. of Germany | 206/349 |
| 2509491 | 9/1976 | Fed. Rep. of Germany | 206/349 |
| 1242088 | 8/1971 | United Kingdom | 206/461 |

*Primary Examiner*—Stephen Marcus

*Attorney, Agent, or Firm*—Ladas, Parry, Von Gehr, Goldsmith & Deschamps

[57] ABSTRACT

A functional blister package for scissors, pliers and other hand tools comprising a display card; a transparent, flexible, blistered elongated covering; an outwardly bent edge on the transparent covering facing the display card and adapted to adhere to said card; the transparent covering being generally shaped to conform to the shape of the hand tool; one end of the generally elongated transparent covering being shaped to closely embrace and lock in place one extremity of the tool; the other end of the transparent covering being splayed to permit of restricted movement of the bladed or sharpened end of the tool; and a cut-out portion in the transparent blistered covering registering with the hand-held part of the tool so as to permit the tool to be grasped and tested by the prospective purchaser.

3 Claims, 7 Drawing Figures

BLISTER PACKAGES FOR SCISSORS, PLIERS AND OTHER HAND TOOLS

This invention relates to blister packages for scissors, pliers and other hand tools.

BACKGROUND OF THE INVENTION

Quality scissors are customarily sold mounted on a display card which carries the name of the maker, distributor and/or marketer and other advertising material. The card and the major part of the scissors are enclosed in a transparent plastic envelope which protects the scissors and display card during storage. The scissors are retained in place by a plastic loop passing over one of the handles. These plastic envelopes have to be slipped by hand over the display card, the loops have to be individually placed around the handle and riveted to the card. This manual assembly is time-consuming and increases the overall production costs.

Blister packages have been known for some time and it is quite customary to mount small items of hardware, stationery, notions and so on on a display card under a blister made of transparent, stiff, but flexible material such as polyvinyl chloride (PVC) and applied by heat and pressure-adhesive means. These known "blisters" completely enclose the article of merchandise and it is impossible for the purchaser to touch or test the article without destroying the "blister."

It is the principal object of the invention to provide a functional blister package primarily, but not exclusively intended for scissors, pliers and other hand tools so as to enable the purchaser to grasp the tool and test-operate it within the confines of the blister.

It is the further object of the invention to provide a blister package for a pair of scissors or other hand tool which can be applied by machine in an automated assembly line.

Another object of the invention is to provide a blister package which permanently houses and displays a pair of scissors or other hand tool yet is partially open so that the scissors can be grasped by the prospective purchaser who wants to get the "feel" of the handles and test the movement and function of the blades.

DETAILED DESCRIPTION OF THE INVENTION

Figure 1:
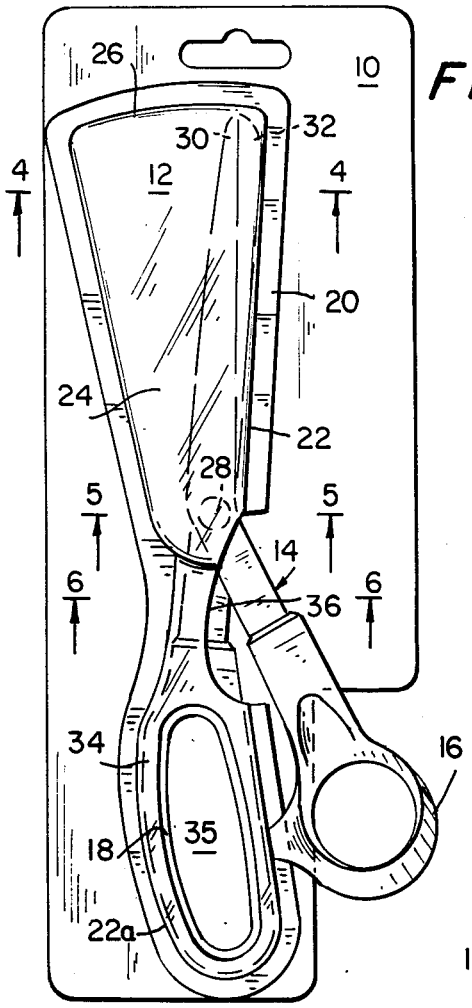
FIG. 1 is a front view of the blister package of the invention as applied to a pair of scissors, the scissors being in the closed position.

Referring to the drawings, the display card 10 has applied to it by heat and pressure-adhesive means a transparent flexible, generally elongated plastic blistered covering 12 which surrounds and holds in place a pair of scissors 14. The scissors shown have plastic-covered contoured handles, 16, 18, but the functional package of the invention is applicable to any type of household scissors, or light hand-operated tools such as gardening clippers or pliers or a crimping tool or shears of various sorts.

The plastic blister has a rim 20 running practically around its entire periphery. The rim 20 is formed by the edge of the plastic being bent at right angles to the upstanding side 22 of the blister. By this arrangement the blister is given a generally U-shaped cross-section as clearly visable in FIGS. 4, 5, 6 and 7, the width of the horizontal limb 24 of the "U" varying at different portions of the blister.

Figure 2:
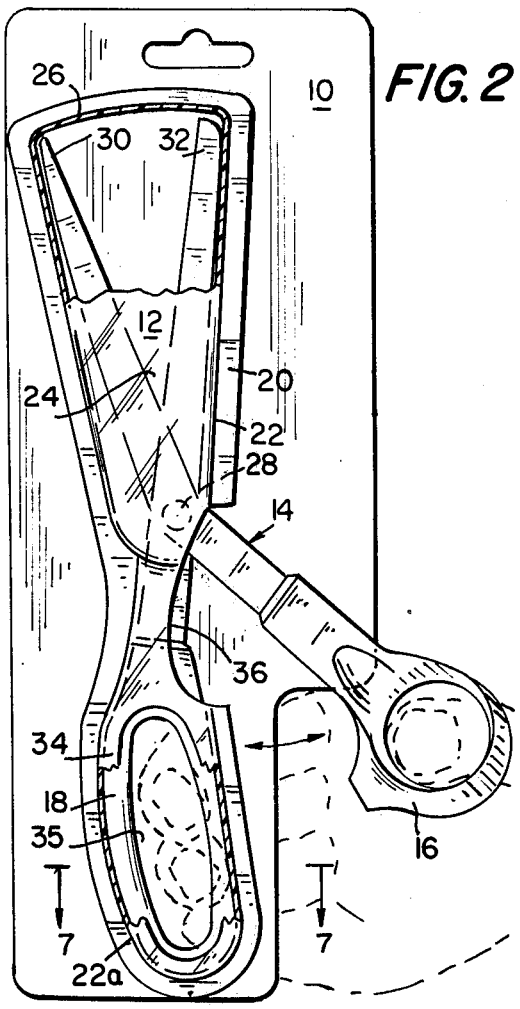
FIG. 2 is a similar figure with the scissors in the open position and showing the customer's hand in dotted lines.
Figure 3:
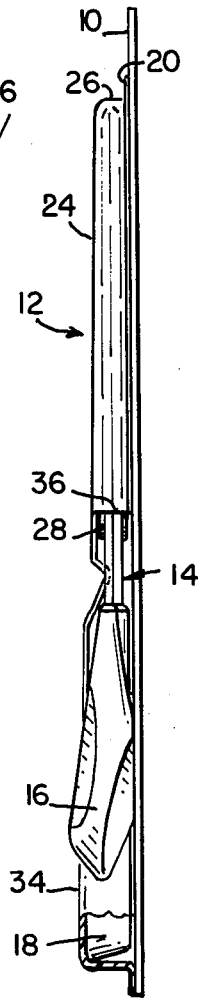
FIG. 3 is a side view of FIG. 1.
Figure 4:
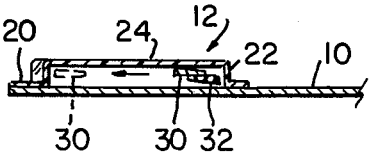
FIGS. 4, 5, 6 and 7 are sectional views taken on lines 4—4, 5—5, 6—6 and 7—7 respectfully.
Figure 5:
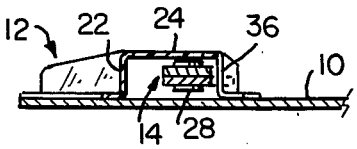
Figure 6:
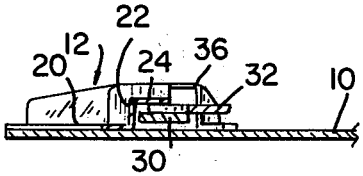
Figure 7:
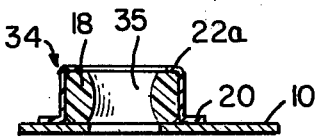

In FIGS. 1 and 2, the upper part of the blister housing the blades is wider along the top 26 which is formed in an arcuate shape, the radius of the arc being roughly equal to the blade length from fulcrum 28 to tips 30, 32. This arc allows the scissors being partially opened as shown in FIG. 2.

The narrowest part of the blister is at the level of the fulcrum or pivot 28 and forms a neck in this area.

The lower part of the blister 34, is generally oblong in outline closely conforming to the shape of the finger hole handle of the scissors with its central portion 35 being cut out to allow insertion of the fingers. As shown in the sectional view of FIG. 7 the sides **22*a* of the blister at this level closely embrace the sides of the scissoı handles 18. In this way, this "finger" handle of the scissors is securely locked in place. The "thumb" handle 16 on the other hand projects outside the blister which is formed with an arcuate cutout 36 at the narrow necked midway portion of the blister at the level of the pivot 28**.

The exact shape of the cut-out which has been described as arcuate is not material as its sole purpose is to allow the "thumb" handle to stick out from the blister and permit its being moved in the plane of the display card 10, that is up and down in the drawing, by the purchaser's thumb which has been shown in dotted outlines in FIG. 2.

Although the shape of the cut-out is not material, the arcuate or part elliptical shape as shown is preferred as it is aesthetically of pleasing appearance.

It will be seen that by the arrangement of the invention, the prospective purchaser can insert this thumb and fingers into the scissor handles so as to obtain the "feel" of the handles and functionally move the blades back and forth within the confines of the blister.

What we claim is:

1. A functional blister package adapted to hold and display scissors, pliers and similar hand tools consisting of two pivotted and relatively movable parts having handles at one end of said parts and working surfaces at the other end of said parts comprising a display card; a transparent, flexible, blistered elongated covering extending substantially entirely over one of the said movable parts and the working surface only of the other of said movable parts, an outwardly bent edge on the transparent covering facing the display card and made to adhere to said card; the transparent covering being generally shaped at one end to substantially enclose and lock in place one handle of one movable part of the tool; the other end of the transparent covering being splayed to permit of restricted movement of the working surface on the other movable parts; and a cut-out portion in the transparent covering substantially midway between its ends to allow the other handle to project outside the covering so as to permit the handle of the tool to be grasped and tested by the prospective purchaser.

2. A blister package as claimed in claim 1, wherein the transparent covering is narrowest at the level of the pivot of the movable parts of the tool and the wider part houses the working surface with that part of the covering being arcuate and widest at the level of the extremities of the working surface so as to permit their being opened and closed without destruction of the transparent covering.

3. A blister package as claimed in claim 1, wherein the elongated covering is narrowest at its central area to form a neck-shaped portion between the working surface and handles of the tool and the elongated covering is formed with an arcuate cut-out at this neck portion for one of the handles to stick out.

* * * * *